US006609324B1

(12) United States Patent
Truitt, Jr.

(10) Patent No.: US 6,609,324 B1
(45) Date of Patent: Aug. 26, 2003

(54) ADJUSTABLE SHOTGUN CHOKE DEVICE

(76) Inventor: Henry J. Truitt, Jr., N. 8995 Camp O. Lane B-2, Cedar River, MI (US) 49813

( * ) Notice: Subject to any disclaimer, the term of this patent is extended or adjusted under 35 U.S.C. 154(b) by 172 days.

(21) Appl. No.: 09/714,923

(22) Filed: Nov. 17, 2000

(51) Int. Cl.[7] ..... F41A 21/42
(52) U.S. Cl. ..... 42/79
(58) Field of Search ..... 42/79

(56) References Cited

U.S. PATENT DOCUMENTS

| | | | | | |
|---|---|---|---|---|---|
| 1,892,522 | A | * | 12/1932 | White | 42/79 |
| 2,092,649 | A | | 9/1937 | Jung | |
| 2,134,238 | A | | 10/1938 | Sedberry | |
| 2,153,246 | A | | 4/1939 | Gibson | |
| 2,466,104 | A | * | 4/1949 | Hilburn | 42/79 |
| D158,792 | S | | 5/1950 | Powell et al. | |
| 2,634,537 | A | * | 4/1953 | Velez et al. | 42/79 |
| 2,663,961 | A | * | 12/1953 | White | 42/79 |
| 2,828,569 | A | * | 4/1958 | Steane | 42/79 |
| 2,861,375 | A | * | 11/1958 | Rodick | 42/79 |
| 2,867,932 | A | * | 1/1959 | Keightley | 42/79 |
| 2,977,702 | A | * | 4/1961 | Schacht | 42/79 |
| 2,989,815 | A | * | 6/1961 | Hare | 42/79 |
| 3,161,979 | A | * | 12/1964 | Lowe | 42/79 |
| 4,058,925 | A | | 11/1977 | Linde et al. | |
| 4,151,671 | A | * | 5/1979 | McPeak | 42/79 |
| 4,713,904 | A | | 12/1987 | Anderson et al. | |
| 5,452,535 | A | * | 9/1995 | See et al. | 42/79 |
| 6,112,447 | A | * | 9/2000 | Androsov | 42/79 |

* cited by examiner

*Primary Examiner*—Charles T. Jordan
*Assistant Examiner*—John W. Zerr

(57) ABSTRACT

An adjustable shotgun choke device for allowing the user to change the choke constrictions without unscrewing one choke and screwing another choke into the barrel of the shotgun. The adjustable shotgun choke device includes a tubular member having open ends and a bore extending therethrough with the tubular member being adapted to be threaded in a barrel of a shotgun; and also includes a sleeve member having a first end, a second end, and a bore extending therethrough with the sleeve member being removably attached to the tubular member.

9 Claims, 2 Drawing Sheets

ADJUSTABLE SHOTGUN CHOKE DEVICE

BACKGROUND OF THE INVENTION

1. Field of the Invention

The present invention relates to a screw-in adjustable shotgun choke and more particularly pertains to a new adjustable shotgun choke device for allowing the user to change the choke constrictions without unscrewing one choke and screwing another choke into the barrel of the shotgun.

2. Description of the Prior Art

The use of a screw-in adjustable shotgun choke is known in the prior art. More specifically, a screw-in adjustable shotgun choke heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,713,904; U.S. Pat. No. 2,134,238; U.S. Pat. No. 4,058,925; U.S. Pat. No. 2,153,246; U.S. Pat. No. Des. 158,792; and U.S. Pat. No. 2,092,649.

While these devices fulfill their respective, particular objectives and requirements, the aforementioned patents do not disclose a new adjustable shotgun choke device. The inventive device includes a tubular member having open ends and a bore extending therethrough with the tubular member being adapted to be threaded in a barrel of a shotgun; and also includes a sleeve member having a first end, a second end, and a bore extending therethrough with the sleeve member being removably attached to the tubular member.

In these respects, the adjustable shotgun choke device according to the present invention substantially departs from the conventional concepts and designs of the prior art, and in so doing provides an apparatus primarily developed for the purpose of allowing the user to change the choke constrictions without unscrewing one choke and screwing another choke into the barrel of the shotgun.

SUMMARY OF THE INVENTION

In view of the foregoing disadvantages inherent in the known types of screw-in adjustable shotgun choke now present in the prior art, the present invention provides a new adjustable shotgun choke device construction wherein the same can be utilized for allowing the user to change the choke constrictions without unscrewing one choke and screwing another choke into the barrel of the shotgun.

The general purpose of the present invention, which will be described subsequently in greater detail, is to provide a new adjustable shotgun choke device which has many of the advantages of the screw-in adjustable shotgun choke mentioned heretofore and many novel features that result in a new adjustable shotgun choke device which is not anticipated, rendered obvious, suggested, or even implied by any of the prior art screw-in adjustable shotgun choke, either alone or in any combination thereof.

To attain this, the present invention generally comprises a tubular member having open ends and a bore extending therethrough with the tubular member being adapted to be threaded in a barrel of a shotgun; and also includes a sleeve member having a first end, a second end, and a bore extending therethrough with the sleeve member being removably attached to the tubular member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable shotgun choke device which has many of the advantages of the screw-in adjustable shotgun choke mentioned heretofore and many novel features that result in a new adjustable shotgun choke device which is not anticipated, rendered obvious, suggested, or even implied by any of the prior art screw-in adjustable shotgun choke, either alone or in any combination thereof.

It is another object of the present invention to provide a new adjustable shotgun choke device which may be easily and efficiently manufactured and marketed.

It is a further object of the present invention to provide a new adjustable shotgun choke device which is of a durable and reliable construction.

An even further object of the present invention is to provide a new adjustable shotgun choke device which is susceptible to a low cost of manufacture with regard to both materials and labor, and which accordingly is then susceptible to low prices of sale to the consuming public, thereby making such an adjustable shotgun choke device economically available to the buying public.

Still yet another object of the present invention is to provide a new adjustable shotgun choke device which provides in the apparatuses and methods of the prior art some of the advantages thereof, while simultaneously overcoming some of the disadvantages normally associated therewith.

Still another object of the present invention is to provide a new adjustable shotgun choke device for allowing the user to change the choke constrictions without unscrewing one choke and screwing another choke into the barrel of the shotgun.

Yet another object of the present invention is to provide a new adjustable shotgun choke device which includes a tubular member having open ends and a bore extending therethrough with the tubular member being adapted to be threaded in a barrel of a shotgun; and also includes a sleeve member having a first end, a second end, and a bore extending therethrough with the sleeve member being removably attached to the tubular member.

Still yet another object of the present invention is to provide a new adjustable shotgun choke device that allows the user to quickly and easily change chokes.

Even still another object of the present invention is to provide a new adjustable shotgun choke device that is convenient and easy to use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
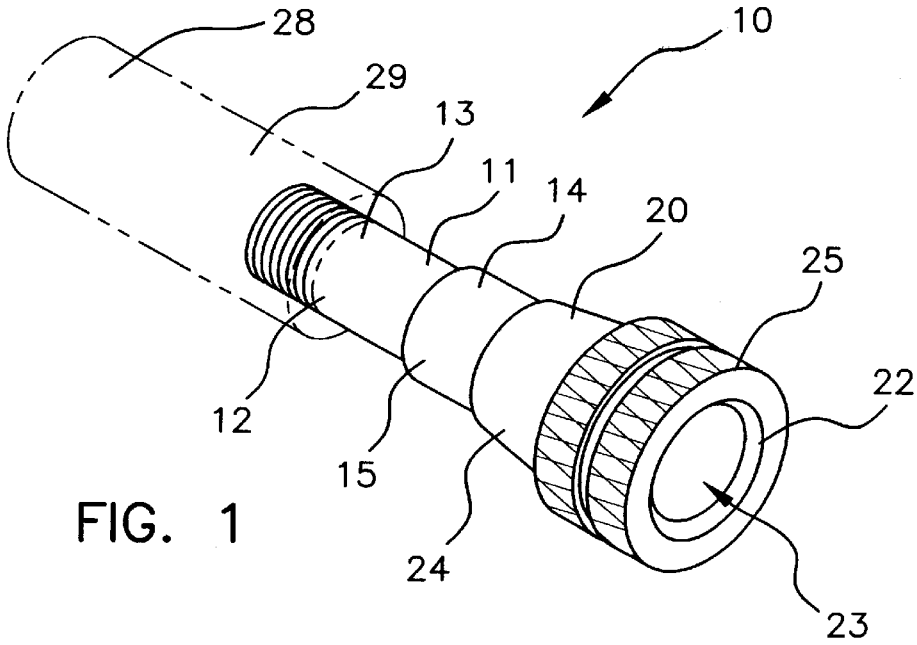
FIG. 1 is a perspective view of a new adjustable shotgun choke device according to the present invention.
Figure 2:
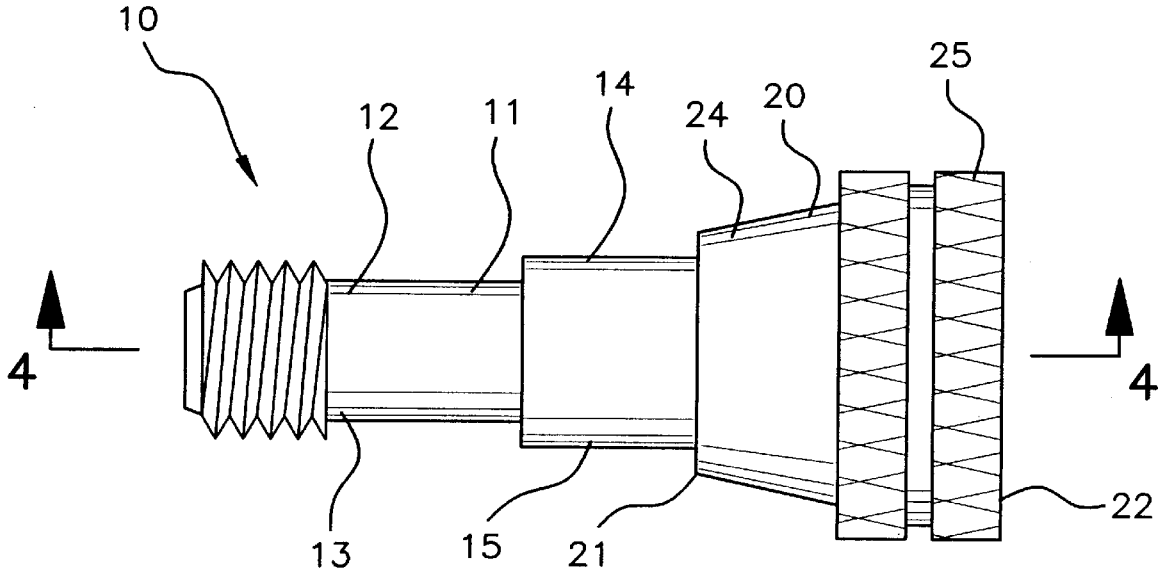
FIG. 2 is a side elevational view of the present invention.
Figure 3:
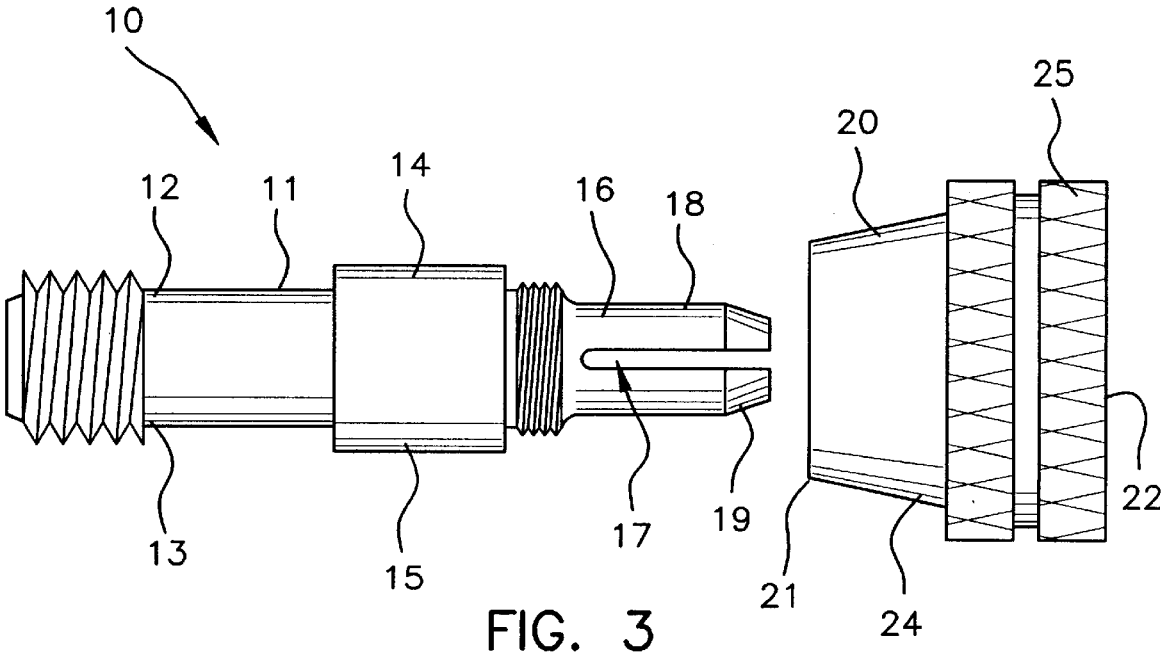
FIG. 3 is an exploded side elevational view of the present invention.
Figure 4:
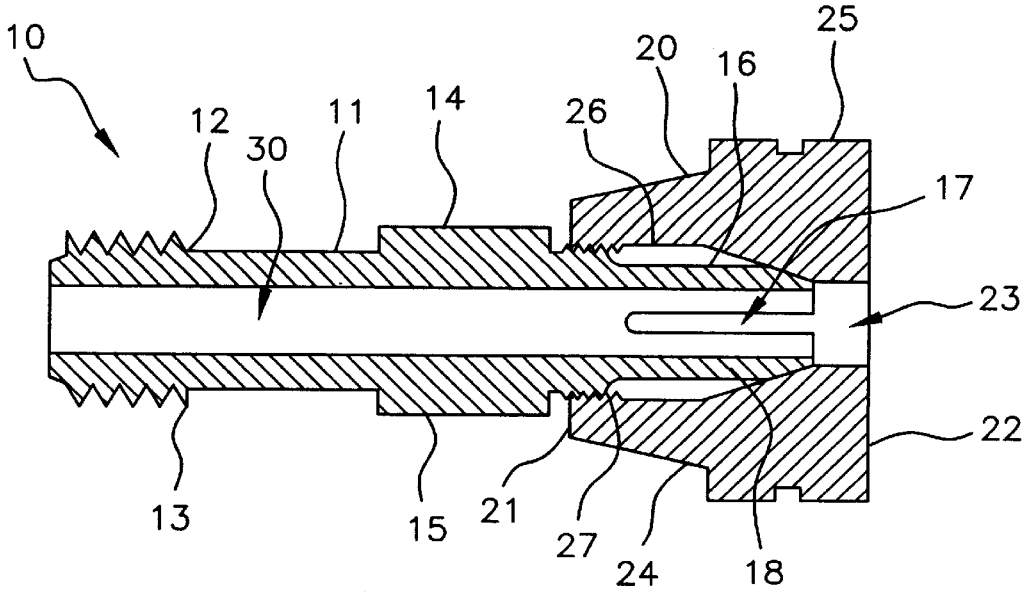
FIG. 4 is a side cross-sectional view of the present invention.

With reference now to the drawings, and in particular to FIGS. 1 through 4 thereof, a new adjustable shotgun choke device embodying the principles and concepts of the present invention and generally designated by the reference numeral 10 will be described.

As best illustrated in FIGS. 1 through 4, the adjustable shotgun choke device 10 generally comprises a tubular member 11 having open ends and a bore 30 extending therethrough with, the tubular member 11 being adapted to be threaded in a barrel 29 of a shotgun 28. The tubular member 11 includes a first end portion 12 having a wall 13 which is threaded about an exterior thereof, and also includes an intermediate portion 14, and further includes a second end portion 16 having a wall 18. The first end portion 12 is adapted to be threaded into the barrel 29 of the shotgun 28. The intermediate portion 14 is enlarged relative to the first and second end portions 12,16 of the tubular member 11. The intermediate portion 14 essentially has an annular flange portion 15. The second end portion 16 also includes diametrically-opposed longitudinal slots 17 extending through the wall 18 thereof and extending from one of the ends of the tubular member 11 and along a portion of a length of the second end portion 16. The wall 18 of the second end portion 16 is threaded about an exterior portion thereof between the intermediate portion 14 and the diametrically-opposed longitudinal slots 17. In addition, the second end portion has a tapered end 19.

A sleeve member 20 has a first end 21, a second end 22, and a bore 23 extending therethrough. The sleeve member 20 is removably attached to the tubular member 11. The sleeve member 20 also includes a tapered first end portion 24 and a collared second end portion 25 having a knurled exterior surface. The bore 23 of the sleeve member 20 is defined by a wall 26 which has a portion 27 that is threaded at the first end 21 of the sleeve member 20. The bore 23 is also tapered from a central portion thereof to the second end 22 of the sleeve member 11 to allow the tapered end 19 of the second end portion 16 of the tubular member 11 to removably seat therein. The sleeve member 20 is adjustably threaded upon the second end portion 16 of the tubular member 11 and is in contactable relationship with the annular flange portion 15 of the intermediate portion 14 of the tubular member 11.

In use, the user threads the first end portion 12 of the tubular member 11 into the barrel 29 of the shotgun 28 and can adjust the choke by adjusting the sleeve member 20 upon the second end portion 16 of the tubular member 11.

As a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be compassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable shotgun choke device comprising:

a tubular member having open ends and a bore extending therethrough, said tubular member being adapted to be threaded in a barrel of a shotgun; and a sleeve member having a first end, a second end, and a bore extending therethrough, said sleeve member being removably attached to said tubular member;

wherein said sleeve member has an exterior tapered first end portion adapted to be tapered towards the barrel and a collared second end portion having a knurled exterior surface.

2. An adjustable shotgun choke device as described in claim 1, wherein said tubular member includes a first end portion having a wall which is threaded on an exterior surface thereof, and also includes an intermediate portion, and further includes a second end portion having a wall, said first end portion being adapted to be threaded into the barrel of the shotgun.

3. An adjustable shotgun choke device as described in claim 2, wherein said intermediate portion is enlarged relative to said first and second end portions of said tubular member, said intermediate portion having an annular flange portion.

4. An adjustable shotgun choke device as described in claim 3, wherein said bore of said sleeve member is defined by a wall which has a portion that is threaded at said first end of said sleeve member, said bore being tapered from a central portion thereof to said second end of said sleeve member, said sleeve member being adjustably mounted upon said second end portion of said tubular member and being in contactable relationship with said annular flange portion of said intermediate portion of said tubular member.

5. An adjustable shotgun choke device as described in claim 2, wherein said second end portion includes diametricalty-opposed longitudinal slots extending through said wall from a second end of said tubular member and, extending from along a portion of a length of said second end portion.

6. An adjustable shotgun choke device as described in claim 5, wherein said wall of said second end portion is threaded about an exterior portion thereof between said intermediate portion and said diametrically-opposed longitudinal slots, said second end portion also having a tapered end for removably seating in said bore of said sleeve member.

7. An adjustable shotgun choke device comprising:

a tubular member having open ends and a bore extending therethrough, said tubular member being adapted to be threaded in a barrel of a shotgun; and a sleeve member having a first end, a second end, and a bore extending therethrough, said sleeve member being removably attached to said tubular member;

wherein said tubular member includes a first end portion having a wall which is threaded about an exterior thereof, and also includes an intermediate portion, and further includes a second end portion having a wall, said first end portion being adapted to be threaded into the barrel of the shotgun;

wherein said intermediate portion is enlarged relative to said first and second end portions of said tubular member, said intermediate portion having an annular flange portion;

wherein said second end portion also includes diametrically-opposed longitudinal slots extending through said wall from a second end of said tubular member and extending from along a portion of a length of said second end portion;

wherein said wall of said second end portion is threaded about an exterior portion thereof between said intermediate portion and said diametrically-opposed longitudinal-slots, said second end portion also having a tapered end for removably seating in said bore of said sleeve member; and wherein said sleeve member also includes a tapered first end portion and a collared second end portion having a knurled exterior surface.

8. An adjustable shotgun choke device a's described in claim 7, wherein said bore of said sleeve member is defined by a wall which has a portion that is threaded at said first end of said sleeve member, said bore being tapered from a central portion thereof to said second end of said sleeve member, said sleeve member being adjustably threaded upon said second end portion of said tubular member and being in contactable relationship with said annular flange portion of said intermediate portion of said tubular member.

9. An adjustable shotgun choke device comprising:

a tubular member having open ends and a bore extending therethrough, said tubular member being adapted to be threaded in a barrel of a shotgun, said tubular member including a first end portion having a wall which is threaded about an exterior thereof, and also including an intermediate portion, and further including a second end portion having a wall, said first end portion being adapted to be threaded into the barrel of the shotgun, said intermediate portion being enlarged relative to said first and second end portions of said tubular member, said intermediate portion having an annular flange portion, said second end portion also including diametrically-opposed longitudinal slots extending through said wall thereof and extending from one of said ends of said tubular member and along a portion of a length of said second end portion, said wall of said second end portion being threaded about an exterior portion thereof between said intermediate portion and said diametrically-opposed longitudinal slots, said second end portion also having a tapered end; and a sleeve member having a first end, a second end, and a bore extending therethrough, said sleeve member being removably attached to said tubular member, said sleeve member also including a tapered first end portion and a collared second end portion having a knurled exterior surface, said bore of said sleeve member being defined by a wall which has a portion that is threaded at said first end of said sleeve member, said bore being tapered from a central portion thereof to said second end of said sleeve member, said sleeve member being adjustably threaded upon said second end portion of said tubular member and being in contactable relationship with said annular flange portion of said intermediate portion of said tubular member.

* * * * *